US008118140B2

(12) United States Patent
Kattainen et al.

(10) Patent No.: US 8,118,140 B2
(45) Date of Patent: Feb. 21, 2012

(54) ELEVATOR SYSTEM WITH A CONTROLLER OF FAST START OF TRAVEL AND METHOD IN CONJUNCTION WITH THE SAME

(75) Inventors: Ari Kattainen, Hyvinkää (FI); Antti Hovi, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 13/036,719

(22) Filed: Feb. 28, 2011

(65) Prior Publication Data

US 2011/0162913 A1 Jul. 7, 2011

Related U.S. Application Data

(63) Continuation of application No. PCT/FI2009/000073, filed on Aug. 5, 2009.

(30) Foreign Application Priority Data

Sep. 1, 2008 (FI) ..... 20080491

(51) Int. Cl.
*B66B 1/34* (2006.01)

(52) U.S. Cl. ..... 187/391; 187/284; 187/293

(58) Field of Classification Search ..... 187/277, 187/288, 289, 303, 284, 351, 293, 391–393, 187/414; 318/362, 799–815
See application file for complete search history.

(56) References Cited

U.S. PATENT DOCUMENTS

| | | | | |
|---|---|---|---|---|
| 2,838,136 | A | 6/1958 | Nikazy | |
| 3,207,265 | A * | 9/1965 | Lund et al. | 187/284 |
| 3,486,101 | A * | 12/1969 | Rufli | 187/292 |
| 3,554,326 | A * | 1/1971 | Hallene et al. | 187/324 |
| 3,584,706 | A | 6/1971 | Hall et al. | |
| 4,042,068 | A | 8/1977 | Ostrander et al. | |
| 4,337,848 | A * | 7/1982 | Kindler | 187/292 |
| 4,368,501 | A | 1/1983 | Gingrich | |
| 4,754,850 | A * | 7/1988 | Caputo | 187/292 |
| 5,049,793 | A * | 9/1991 | Tanaka et al. | 318/436 |
| 5,159,162 | A * | 10/1992 | Tatino | 187/280 |
| 7,775,330 | B2 * | 8/2010 | Kattainen et al. | 187/393 |
| 7,891,467 | B2 * | 2/2011 | Kattainen et al. | 187/394 |
| 2009/0255762 | A1 * | 10/2009 | Ketonen et al. | 187/247 |

* cited by examiner

*Primary Examiner* — Anthony Salata
(74) *Attorney, Agent, or Firm* — Birch, Stewart, Kolasch & Birch, LLP

(57) ABSTRACT

An elevator system and a method for accelerating the starting of travel in an elevator system are provided. The elevator system includes an elevator control system for implementing controlled motion of an elevator car; a door mechanism control system for implementing controlled movement of the elevator car door; and a door coupler, for forming a mechanical coupling between elevator car door and landing door; and a controller of fast start of travel, which has an input for elevator car position data, an input for landing door position data, an input for car door position data, and at least one output for activating the elevator motor power supply circuit and the elevator brake release circuit.

9 Claims, 3 Drawing Sheets

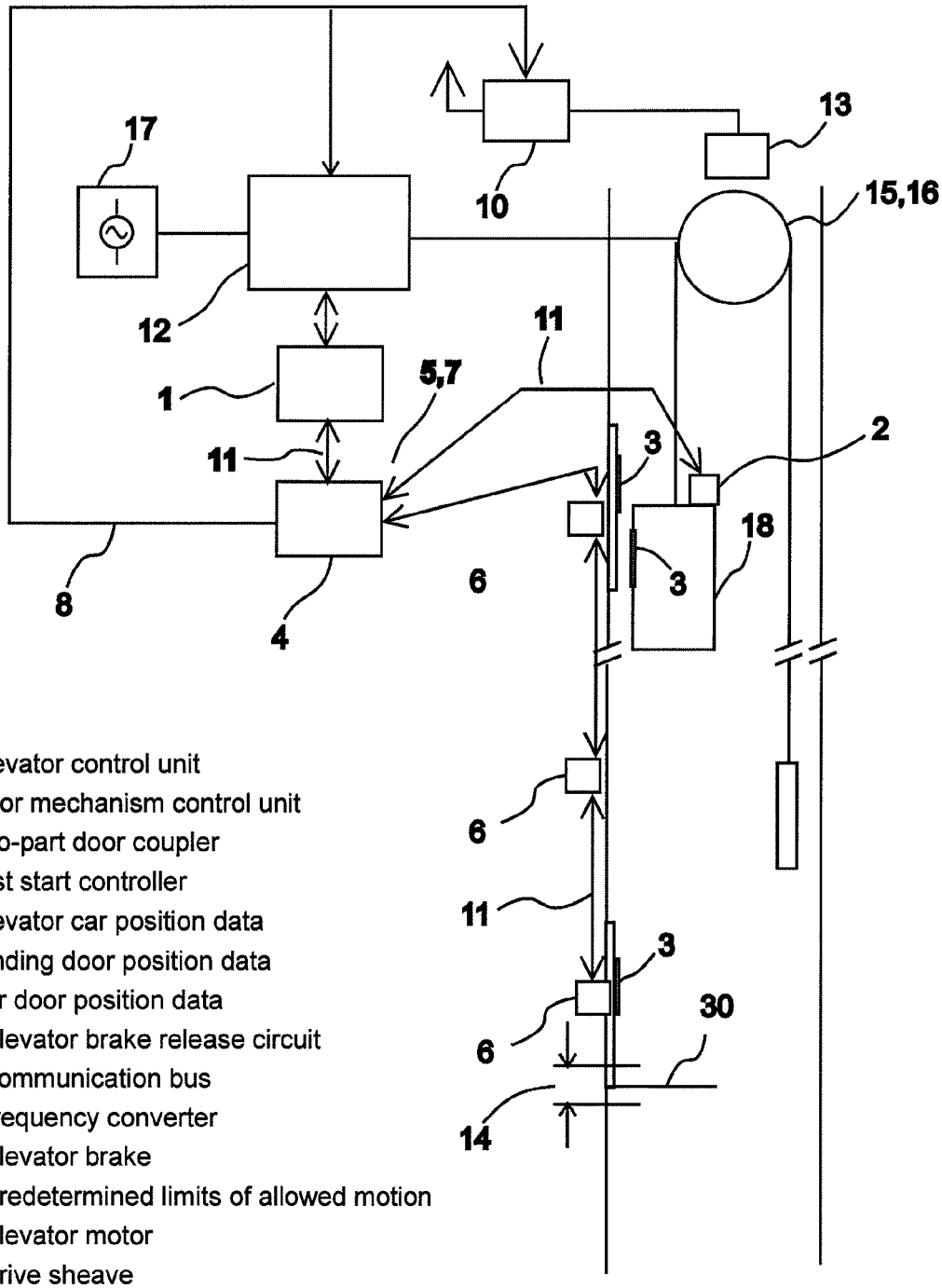

Figure 2:
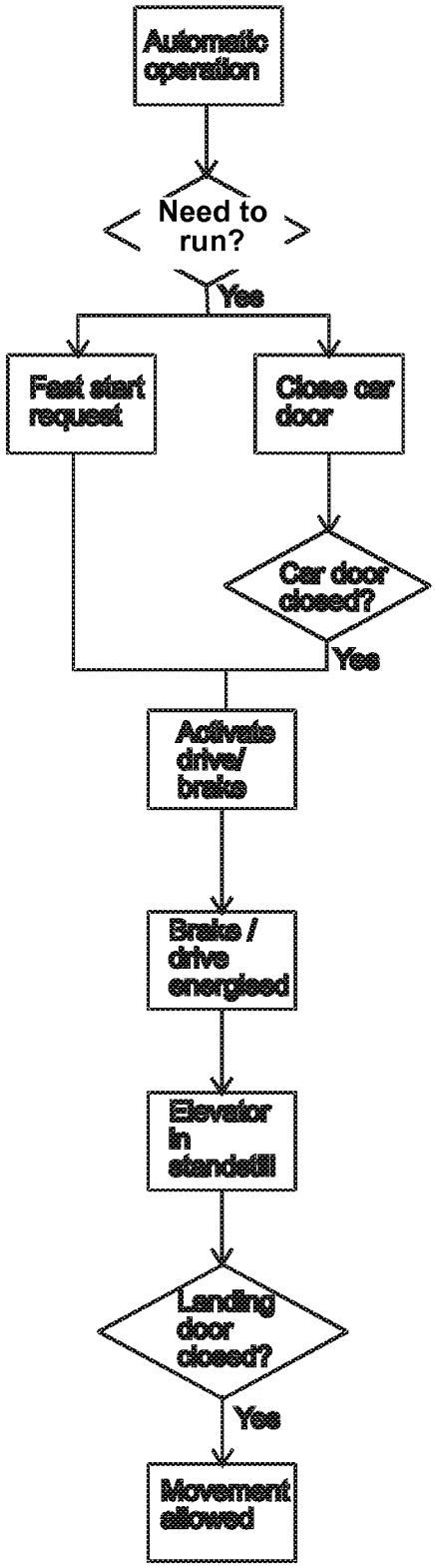

1: elevator control unit
2: door mechanism control unit
3: two-part door coupler
4: fast start controller
5: elevator car position data
6: landing door position data
7: car door position data
10: elevator brake release circuit
11: communication bus
12: frequency converter
13: elevator brake
14: predetermined limits of allowed motion
15: elevator motor
16: drive sheave
17: electric network
18: elevator car
30: building floor

FIG. 1

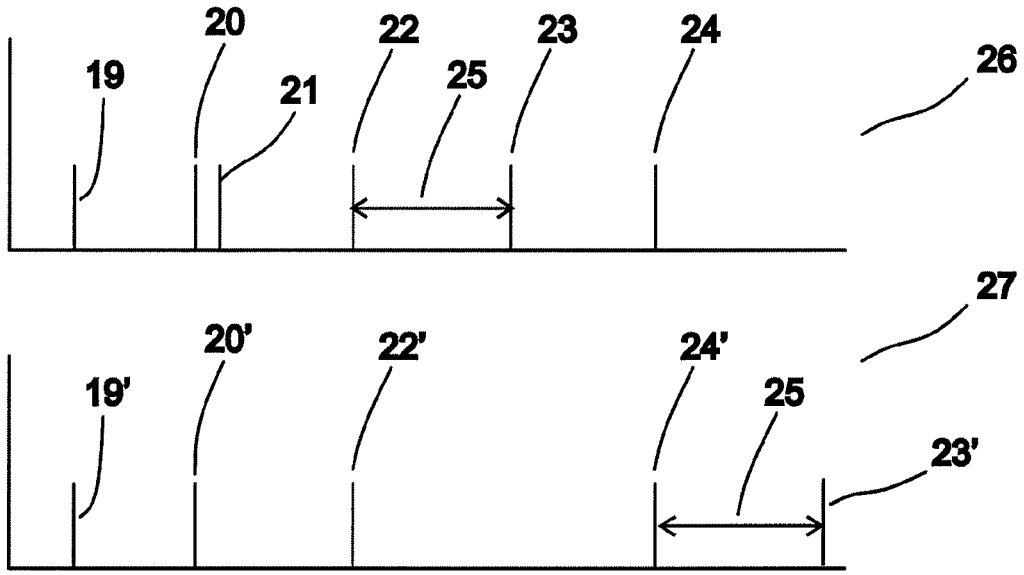

FIG. 3

19, 19': The elevator system starts serving a call

20, 20': A close door request is sent

21: The elevator control unit sends a fast start request to the fast start controller

22: The elevator car door is closed, and thereafter the fast start controller activates the motor power supply circuit and the brake release circuit

22': The elevator car door is closed

23: Current Supply to the motor is started and the brake is released upon the lapse of a predetermined starting delay

24: The elevator landing door is closed, and immediately thereafter the fast start controller sends to the elevator control system a permission to set the elevator in motion so that the elevator can start running

24': The elevator landing door is closed, and thereafter the elevator control system initiates the supply of current through the power supply circuit to the elevator motor and permits release of the elevator brake

25: Predetermined starting delay

26: Timing diagram for a fast start sequence according to the invention

27: Timing diagram for a prior-art starting sequence

ELEVATOR SYSTEM WITH A CONTROLLER OF FAST START OF TRAVEL AND METHOD IN CONJUNCTION WITH THE SAME

CROSS REFERENCE TO RELATED APPLICATIONS

This application is a Continuation of copending PCT International Application No. PCT/FI2009/000073 filed on Aug. 5, 2009, which claims the benefit of Finnish Patent Application No. 20080491 filed in Finland on Sep. 1, 2008. The entire content of each of the above documents is hereby incorporated by reference into the present application.

The present invention relates to the starting of travel of an elevator.

One of the most important parameters describing the performance of an elevator system is transport capacity. A significant factor affecting transport capacity is the so-called door-to-door time, i.e. the time within which the passenger can be transported from the starting floor to the destination floor. This length of time can be reduced e.g. by increasing the acceleration/deceleration of the elevator car, and by increasing the maximum velocity of the elevator car.

Increasing the acceleration/deceleration usually requires increasing the current capacity of the elevator motor and of the power supply circuit feeding the motor. Increasing the maximum velocity additionally also increases the maximum power taken from the electric network, so the electric connection has to be designed for a higher power level.

The door-to-door time can also be reduced e.g. by increasing the speed of movement of the elevator car door and that of the corresponding landing door. However, faster movement is a disadvantage in respect of convenience of use of the elevator and may at worst lead to danger situations The object of the present invention is to solve some of the above-described problems as well as problems appearing below in the description of the invention. One of the objects of the invention is to accelerate the starting of travel of an elevator.

The elevator system of the invention is characterized by what is disclosed in the characterizing part of claim 1. The method of the invention for accelerating the starting of travel in an elevator system is characterized by what is disclosed in the characterizing part of claim 5. Other embodiments of the invention are characterized by what is disclosed in the other claims. Inventive embodiments are also presented in the description part and drawings of the present application. The inventive content disclosed in the application can also be defined in other ways than is done in the claims below. The inventive content may also consist of several separate inventions, especially if the invention is considered in the light of explicit or implicit sub-tasks or with respect to advantages or sets of advantages achieved. In this case, some of the attributes contained in the claims below may be superfluous from the point of view of separate inventive concepts. The features of different embodiments of the invention can be applied in connection with other embodiments within the scope of the basic inventive concept The elevator system of the invention comprises an elevator control system for implementing controlled movement of the elevator car; a door mechanism control system for implementing controlled movement of the elevator car door; and a door coupler for forming a mechanical coupling between the elevator car door and the landing door. In addition, the elevator system comprises a controller of fast start of travel, said controller having an input for elevator car position data, an input for landing door position data, an input for car door position data and at least one output for activating the elevator motor power supply circuit and the elevator brake release circuit. Between the elevator control system, the fast start controller and the door mechanism control system, a communication bus is provided. The elevator control system has been adapted to send to the door mechanism control system a request for closing the elevator car door, and in conjunction with this a fast start request to the fast start controller, the fast start controller being adapted to determine the progress of fast starting on the basis of elevator car position data, landing door position data and car door position data. After the elevator car door has been closed, the fast start controller is adapted to send an activation signal for activating the elevator motor power supply circuit and the elevator brake release circuit. The elevator control system is adapted to allow current to be passed through the activated elevator motor power supply circuit to the elevator motor so as to keep the elevator car immovable in the elevator shaft. Moreover, the elevator control system is adapted to release the elevator brake by controlling the activated brake release circuit. After the landing door has been closed, the fast start controller is adapted to send to the elevator control system a permission to start travel of the elevator.

In the method of the invention for accelerating the starting of travel in an elevator system, a fast start controller is fitted in the elevator system; a communication bus is fitted between the elevator control system, door mechanism control system and fast start controller; a close car door request is sent from the elevator control system to the door mechanism control system; a fast start request is sent from the elevator control system to the fast start controller; the progress of fast starting is determined by means of the fast start controller on the basis of elevator car position data, landing door position data and car door position data; after the elevator car door has been closed, the elevator motor power supply circuit and the elevator brake release circuit are activated by the fast start controller; current is supplied by the elevator control system through the activated elevator motor power supply circuit to the elevator motor so as to keep the elevator car immovable in the elevator shaft; the elevator brake is released by the elevator control system by controlling the activated brake release circuit; and after the landing door has been closed, a permission to start travel is sent from the fast start controller to the elevator control system.

The invention provides at least one of the following advantages, among others:

By using a fast start controller, more effective control of the operation start sequence of the elevator can be achieved. Power can be supplied to the elevator motor and the brake can be released immediately upon closing of the car door, before the landing door has been closed. Thus, when the landing door is closed, the brake has already been released and the supply of power to the motor has been started, so the elevator can start moving immediately upon closing of the landing door. At the same time, the effects of the brake release delay and the start-up delay of the motor power supply circuit on the duration of the operation start sequence are eliminated at least partially. As the operation start sequence is accelerated, the duration of travel, i.e. the door-to-door time of the elevator is shortened as well.

The reduction in the travel start-up delay is also an advantage in different emergency situations where passengers have to be moved as quickly as possible into spaces classified as safe areas in the building. Such emergencies may arise e.g. in consequence of an earthquake or fire.

As the start-up is monitored by the fast start controller, more accurate information is also obtained about the progress of the operation start sequence. This improves the safety of the starting of travel.

In the following, the invention will be described in detail by referring to the attached drawings, wherein FIG. 1 represents an elevator system according to the invention FIG. 2 represents a fast start sequence according to the invention FIG. 3 is a timing diagram representing a prior-art operation start sequence and a fast start sequence according to the invention.

FIG. 1 represents an elevator system in which an elevator car 18 has been fitted to be moved in an elevator shaft according to control commands received from an elevator control unit 1. The elevator car 18 and counterweight are connected to the drive sheave 16 of the elevator machine by elevator ropes. The elevator motor 15, which is concentrically coupled with the drive sheave 16, obtains the power required for moving the elevator car 18 from an electric network 17 via a frequency converter 12. The elevator motor is fed with a supply voltage of variable amplitude and frequency, which is adjusted by means of the frequency converter to implement controlled motion of the elevator car. Fitted in conjunction with the elevator car 18 are a door mechanism and a door mechanism control unit 2, to implement controlled motion of the elevator car door. Fitted in conjunction with the elevator car door is a first part of a two-part door coupler 3, while a second part of the door coupler 3 is fitted in conjunction with the landing doors. The door coupler 3 has been fitted to form a mechanical coupling between the elevator car door and the landing door, which is located in the immediate vicinity of the car door. The door coupler moves the landing door in response to the movement of the elevator car door.

Fitted in the elevator system is a controller 4 of fast start of travel. The fast start controller has an input for elevator car position data. Permanent magnets are fitted in conjunction with the building floors 30 in the elevator system. Fitted in conjunction with the elevator car is a measuring device provided with Hall sensors to measure elevator car position data 5 based on the magnetic field generated by the permanent magnets. Fitted between the elevator car 18 and the controller 4 of fast start of travel is a communication bus 11, over which the elevator car position data 5 is transmitted to the controller 4 of fast start of travel.

The fast start controller also has an input for landing door position data and car door position data. Fitted in conjunction with the landing doors are safety switches 6, which are opened and closed according to the movement of the landing doors. A measurement bus is fitted between the landing door safety switches and the fast start controller 4, via which bus the fast start controller monitors the landing door position data indicated by the safety switches 6. A safety switch 7 is fitted in a corresponding manner in conjunction with the elevator car door as well. The car door position data indicated by the safety switch 7 is transmitted to the fast start controller 4 over the communication bus 11 between the elevator car 18 and the fast start controller 4.

When the elevator control unit 1 begins serving an elevator call, it sends to the door mechanism control unit 2 a request to close the door, and in connection with this it also sends to the fast start controller 4 a fast start request. The fast start controller 4 now starts determining the progress of fast start on the basis of elevator car position data 5, landing door position data 6 and car door position data.

The fast start controller 4 has a relay output 8 for the activation of the elevator motor power supply circuit 12 and the elevator brake release circuit 10. The relay output is used to control a contact which has been fitted in a safety circuit of the elevator motor power supply circuit and elevator brake release circuit in such manner that an open contact disables the functioning of the brake release circuit as well as the functioning of the active power supply components of the elevator motor power supply circuit. These active power supply components include e.g. contactors, as well as the IGBT transistors in the motor bridge of the frequency converter.

After the elevator car door has been closed, the fast start controller 4 sends via the relay output an activation signal to activate the elevator motor power supply circuit 12 and the elevator brake release circuit 10. The elevator control unit 1 reads the state of the activation signal. Upon detecting activation, the elevator control unit 1 allows current to be passed via the elevator motor power supply circuit 12 to the elevator motor 15. The elevator control system 1 adjusts the frequency and amplitude of the motor supply voltage so as to keep the elevator car immovable at the landing 30. The elevator control system 1 also releases the machine brake 13 by supplying current through the activated brake release circuit 10 to the brake coil.

The door coupler moves the landing door in response to the movement of the car door. The landing door is closed with a delay relative to the car door. The closing delay between car door and landing door may be e.g. about 600 milliseconds.

Upon detecting the closing of the landing door, the fast start controller 4 sends to the elevator control system 1 a permission to set the elevator in motion, whereupon the elevator can start moving away from the landing zone.

The fast start controller 4 keeps monitoring the progress of fast start, and if it detects a functional deviation, the fast start controller deactivates the elevator motor power supply circuit 12 and the elevator brake control circuit 10.

In consequence, possible power flow to the elevator motor 15 ceases and the brake 13 closes. The fast start controller also sends data regarding the functional deviation to the elevator control system 1. A functional deviation may be determined e.g. from a situation where the duration of the fast start sequence exceeds a set maximum. Such a situation may be established to be present if e.g. the closing of the elevator car door or landing door takes too long. The fast start controller also monitors elevator car 18 movement at the landing 30 during fast start. Elevator car movement is subject to predetermined limits of allowed motion 14. The fast start controller establishes the presence of a functional deviation if the elevator car movement, such as position, velocity or acceleration, deviates to a value outside the allowed range of motion defined by the limit values 14.

FIG. 2 represents a fast start sequence according to the invention in the form of a flow diagram. When the operating mode of the elevator system changes to normal mode (automatic operation), the system is ready to serve calls (need to run?). A 'close car door' request is sent to the door mechanism control unit 2. In connection with this, a fast start request is also generated. After the elevator car door has been closed (car door closed), the motor power supply circuit and the brake release circuit are activated (activate drive/brake), whereupon the brake is released and the supply of power to the motor is started (brake/drive energised). The elevator car is held immovable at the landing (elevator in standstill) by adjusting the motor torque. After the landing door has been closed (landing door closed), the elevator can start moving away from the landing (movement allowed).

In FIG. 3, the upper graph 26 represents an example of a timing diagram for a fast start sequence according to the invention, while the lower graph 27 represents a corresponding timing diagram for a prior-art starting sequence.

In this embodiment of the invention, the fast start sequence begins when the elevator system starts serving 19 a call. The elevator control unit 1 sends a close door request 20 to the door mechanism control unit 2. In connection with this, the elevator control unit also sends a fast start request 21 to the fast start controller 4. Once the elevator landing door has been closed 22, the fast start controller activates the motor power supply circuit 12 and the brake release circuit 10 of the elevator. After this, the elevator control unit 1 allows current to be passed through the activated elevator motor power supply circuit 12 to the elevator motor 15 and causes the elevator brake 13 to be released. The supply of current to the motor is started and the brake is released 23 upon the lapse of a predetermined starting delay 25. Next, immediately after closing 24 of the landing door, the fast start controller 4 sends to the elevator control system 1 a permission to set the elevator in motion, so the elevator can start running.

In the prior-art start sequence 27, when the system starts serving a call 19', a close door request 20' is sent to the car door controller. The system then waits until the elevator car door is closed 22' and further until the landing door is closed 24'. After the landing door has been closed, the elevator control system initiates the supply of current through the power supply circuit to the elevator motor and permits release of the elevator brake. After the starting delays 25' of the power supply and brake release functions, the supply of current to the motor begins and the brake is released 23', so the elevator can start moving. Thus, the start of elevator travel in the prior-art operating sequence 27 is delayed as compared to the fast start sequence 26 of the present invention. This delay is due to the starting delays 25 in the starting of the power supply circuit and the brake release function.

The invention has been described above with reference to a few embodiment examples. It is obvious to a person skilled in the art that the invention is not exclusively limited to the above-described embodiments, but that many other embodiments are possible within the scope of the inventive concept defined in the claims.

The fast start controller may be integrated with another elevator control device or safety device.

The elevator system may be a counterweighted or non-counterweighted system. The elevator system may also be a system with or without machine room.

The elevator motor may be an alternating-current motor, such as e.g. a permanent-magnet synchronous motor or an induction motor.

The position of the elevator car can also be determined e.g. on the basis of measurement of the velocity or acceleration of the elevator car in a manner known in itself. On the other hand, the elevator car position can also be determined indirectly e.g. from the motion of the elevator motor or the drive sheave of the elevator.

The fast start controller is a safety device, so it can be designed under observance of the requirements applying to redundancy of electronic safety devices. Thus, the fast start controller may employ e.g. redundant twin-processor control and/or a doubled measurement bus. Data may be transmitted over the said measurement bus in serial or parallel mode. The measurement signal may also be analog, and the measurement data may be transmitted e.g. as a voltage or current signal. The data transmission connection may also be wireless.

The invention claimed is:

1. An elevator system, comprising:

an elevator control system, for implementing controlled movement of the elevator car;

a door mechanism control system, for implementing controlled movement of the elevator car door;

a door coupler, for forming a mechanical coupling between elevator car door and landing door; and a controller of fast start of travel, said controller having:

an input for elevator car position data;

an input for landing door position data;

an input for car door position data; and at least one output for activating the elevator motor power supply circuit and the elevator brake release circuit, wherein between the elevator control system, the fast start controller and the door mechanism control system, a communication bus is provided, the elevator control system is configured to send to the door mechanism control system a request for closing the elevator car door, and in connection with this a fast start request to the fast start controller, the fast start controller being configured to determine the progress of fast starting on the basis of elevator car position data, landing door position data and car door position data, the fast start controller is configured to send, after the elevator car door has been closed, an activation signal for activating the elevator motor power supply circuit and the elevator brake release circuit, the elevator control system is configured to allow current to be passed through the activated elevator motor power supply circuit to the elevator motor so as to keep the elevator car immovable in the elevator shaft, the elevator control system is configured to release the elevator brake by controlling the activated brake release circuit, and the fast start controller is configured to send to the elevator control system, after the landing door has been closed, a permission to start travel of the elevator.

2. The elevator system according to claim 1, wherein the elevator system comprises an elevator motor, the elevator system comprises a frequency converter for adjusting the frequency and amplitude of the supply voltage of the elevator motor, and the elevator control system is configured to allow current to be passed through the activated elevator motor power supply circuit to the elevator motor by adjusting the frequency and amplitude of the supply voltage of the elevator motor so as to keep the elevator car immovable in the elevator shaft.

3. An elevator system, comprising:

an elevator control system, for implementing controlled movement of the elevator car;

a door mechanism control system, for implementing controlled movement of the elevator car door;

a door coupler, for forming a mechanical coupling between elevator car door and landing door; and a controller of fast start of travel, said controller having:

an input for elevator car position data;

an input for landing door position data;

an input for car door position data; and at least one output for activating the elevator motor power supply circuit and the elevator brake release circuit, wherein between the elevator control system, the fast start controller and the door mechanism control system, a communication bus is provided, the elevator control system is configured to send to the door mechanism control system a request for closing the elevator car door, and in connection with this a fast start request to the fast start controller, the fast start controller being configured to determine the progress of fast starting on the basis of elevator car position data, landing door position data and car door position data, the fast start controller is configured to send, after the elevator car door has been closed, an activation signal for activating the elevator motor power supply circuit and the elevator brake release circuit, the elevator control system is configured to allow current to be passed through the activated elevator motor power supply circuit to the elevator motor so as to keep the elevator car immovable in the elevator shaft, the elevator control system is configured to release the elevator brake by controlling the activated brake release circuit, the fast start controller is configured to send to the elevator control system, after the landing door has been closed, a permission to start travel of the elevator, and the fast start controller is configured to determine the progress of fast starting on the basis of elevator car position data, landing door position data and car door position data, and if it detects a functional deviation, to deactivate the elevator motor power supply circuit and the elevator brake control circuit and to send data regarding the functional deviation to the elevator control system.

4. The elevator system according to claim 1, wherein elevator car movement during fast starting is subject to predetermined limits of allowed motion, and the fast start controller is configured to monitor elevator car movement during fast starting and to establish the presence of a functional deviation if the elevator car movement deviates to a value outside the allowed range of motion defined by the limit values, and to send data regarding the functional deviation to the elevator control system.

5. A method for accelerating the starting of travel in an elevator system, comprising the steps of:

fitting a fast start controller in the elevator system;

fitting a communication bus between the elevator control system, door mechanism control system and fast start controller;

sending a request to close the elevator car door from the elevator control system to the door mechanism control system;

sending a fast start request from the elevator control system to the fast start controller;

determining the progress of fast starting by means of the fast start controller on the basis of elevator car position data, landing door position data and car door position data;

after the elevator car door has been closed, activating the elevator motor power supply circuit and the elevator brake release circuit by the fast start controller;

supplying current by the elevator control system through the activated elevator motor power supply circuit to the elevator motor so as to keep the elevator car immovable in the elevator shaft;

releasing the brake by the elevator control system by controlling the activated brake release circuit; and after the landing door has been closed, sending a permission to start travel from the fast start controller to the elevator control system.

6. The method according to claim 5, further comprising the step of passing current by the elevator control system through the activated elevator motor power supply circuit to the elevator motor by adjusting the frequency and amplitude of the supply voltage of the elevator motor so as to keep the elevator car immovable in the elevator shaft.

7. The elevator system according to claim 2, wherein the fast start controller is configured to determine the progress of fast starting on the basis of elevator car position data, landing door position data and car door position data, and if it detects a functional deviation, to deactivate the elevator motor power supply circuit and the elevator brake control circuit and to send data regarding the functional deviation to the elevator control system.

8. The elevator system according to claim 2, wherein elevator car movement during fast starting is subject to predetermined limits of allowed motion, and the fast start controller is configured to monitor elevator car movement during fast starting and to establish the presence of a functional deviation if the elevator car movement deviates to a value outside the allowed range of motion defined by the limit values, and to send data regarding the functional deviation to the elevator control system.

9. The elevator system according to claim 2, wherein elevator car movement during fast starting is subject to predetermined limits of allowed motion, and the fast start controller is configured to monitor elevator car movement during fast starting and to establish the presence of a functional deviation if the elevator car movement deviates to a value outside the allowed range of motion defined by the limit values, and to send data regarding the functional deviation to the elevator control system.

* * * * *